US009421594B2

(12) United States Patent
Ueno et al.

(10) Patent No.: US 9,421,594 B2
(45) Date of Patent: Aug. 23, 2016

(54) METHOD FOR MANUFACTURING CURVED HOLLOW PIPE

(75) Inventors: Masaki Ueno, Yokohama (JP); Yuji Suenaga, Yokohama (JP)

(73) Assignee: Yorozu Corporation, Yokohama (JP)

( * ) Notice: Subject to any disclaimer, the term of this patent is extended or adjusted under 35 U.S.C. 154(b) by 48 days.

(21) Appl. No.: 14/374,293

(22) PCT Filed: Jan. 26, 2012

(86) PCT No.: PCT/JP2012/051695
§ 371 (c)(1),
(2), (4) Date: Nov. 21, 2014

(87) PCT Pub. No.: WO2013/111308
PCT Pub. Date: Aug. 1, 2013

(65) Prior Publication Data

US 2015/0151344 A1 Jun. 4, 2015

(51) Int. Cl.

| | |
|---|---|
| ***B21C 37/15*** | (2006.01) |
| ***B21D 5/01*** | (2006.01) |
| ***B21D 5/00*** | (2006.01) |
| ***B21K 7/12*** | (2006.01) |
| *B21D 53/88* | (2006.01) |

(52) U.S. Cl.
CPC ..... *B21C 37/15* (2013.01); *B21D 5/00* (2013.01); *B21D 5/015* (2013.01); *B21K 7/12* (2013.01); *B21D 53/88* (2013.01)

(58) Field of Classification Search
CPC ..... B21D 5/015; B21D 5/00; B21D 53/88; B21K 7/12; B21C 37/15
See application file for complete search history.

(56) References Cited

U.S. PATENT DOCUMENTS 4,148,426 A * 4/1979 Midzutani ..... B21D 5/015 228/146
2015/0151344 A1* 6/2015 Ueno ..... B21D 5/015 72/51

FOREIGN PATENT DOCUMENTS

JP H09155446 A 6/1997
JP 2008080381 A 4/2008

OTHER PUBLICATIONS

International Search Report for PCT/JP2012/051695 mailed Apr. 24, 2012.

*Primary Examiner* — David B Jones
(74) *Attorney, Agent, or Firm* — Drinker Biddle & Reath LLP

(57) ABSTRACT

[Problem] A method for manufacturing a bent hollow pipe is provided, in which even when a three-dimensionally bent pipe is formed, a gap, an uneven thickness, and the like would not occur at contact portions at the ends of both of the flange portions when press work is finished, and thus a pipe having the high quality contact portions can be formed.
[Solution] In a method for manufacturing a bent hollow pipe, a material W, which is to be processed and which is a flat plate extending a first plane formed by a first direction and a second direction perpendicular to the first direction, is pressed in a stepwise manner using a plurality of forming dies from a third direction perpendicular to the first plane, so that two sides of a second plane formed by the second direction and the third direction of the material W are brought into contact with each other, and the bent hollow pipe is made to be bent and extend in a three dimensional manner that is bent in the first plane and in the second plane. The method includes a step in which a push out portion 13 is formed that is pushed out onto the material W in the third direction and that is bent and extends within a third plane formed by the first direction and the third direction in a press work, and extension portions 15 are formed to extend away from each other at both sides which sandwich the push out portion 13 of the material W, and flange portions 16 are formed that are bent, in a direction opposite to a push out direction of the push out portion 13, at ends of the extension portions 15, a step in which while bending is maintained between the extension portions 15 and the flange portions 16, a bent portions 17 between the push out portion 13 and the extension portions 15 are bent in the opposite directions, so that the both of the flange portions 16 are formed in a direction in which the both of the flange portions 16 face each other, a step in which the both of the flange portions 16 of a three-dimensionally bent portion P that is bent in the first plane and in the second plane are bent and brought closer to each other as compared with both of the flange portions 16 in a portion other than the three-dimensionally bent portion P, and a step of bringing ends of the flange portions 16 into contact with each other.

7 Claims, 17 Drawing Sheets

METHOD FOR MANUFACTURING CURVED HOLLOW PIPE

TECHNICAL FIELD

The present invention relates to a method for manufacturing a bent hollow pipe, and more particularly to a method for manufacturing a suspension arm.

BACKGROUND ART

An example of method for manufacturing a bent hollow pipe such as a suspension arm for a vehicle includes the manufacturing method described in Patent Literature 1. This method is a method for pressing a flat plate, which is a material, into ultimately a two-dimensionally bent hollow pipe through press-forming in a stepwise manner using multiple forming dies, and thus the bent hollow pipe can be formed without using a core. In this method, first, flange portions extending in directions away from each other are formed in a flat plate, subsequently, both of the flange portions are bent in a press direction so as to be in substantially parallel with each other, and thereafter, both of the flange portions are brought into contact with each other along the inner wall of a forming die, so that a pipe is formed.

CITATION LIST

Patent Literatures

Patent Literature 1: Japanese Patent No. 3114918

SUMMARY OF INVENTION

Technical Problem

However, when a three-dimensionally bent pipe is formed according to the above method, there is a problem in that, when both of the flange portions are bent in a substantially parallel with each other, the flange portion is too long in some portions, and the flange portion is drawn and become too short in other portions, and unstable shrinking occurs, which makes it difficult to form a preferable pipe.

The present invention is made to solve the problem associated with the above conventional techniques, and it is an object of the present invention to provide a method for manufacturing a bent hollow pipe, wherein even when a three-dimensionally bent pipe is formed, a gap, an uneven thickness, and the like would not occur at contact portions at the ends of both of the flange portions when press work is finished, and thus a pipe having the high quality contact portions can be formed.

Means for Solving Problem

The above object is achieved by the inventions described in (1) to (4) below.

(1) A method for manufacturing a bent hollow pipe, in which a material, which is to be processed and which is a flat plate extending in a first plane formed by a first direction and a second direction perpendicular to the first direction, is pressed in a stepwise manner using a plurality of forming dies from a third direction perpendicular to the first plane, so that two sides of a second plane formed by the second direction and the third direction of the material are brought into contact with each other, and the bent hollow pipe is made to be bent and extend in a three dimensional manner that is bent in the first plane and in the second plane, and the method includes a step in which a push out portion is formed that is pushed out onto the material in the third direction and that is bent and extends within a third plane formed by the first direction and the third direction in a press work, and extension portions are formed to extend away from each other at both sides which sandwich the push out portion of the material, and flange portions are formed that are bent, in a direction opposite to a push out direction of the push out portion, at ends of the extension portions, a step in which while bending is maintained between the extension portions and the flange portions, a bent portions between the push out portion and the extension portions are bent in the opposite directions, so that the both of the flange portions are formed in a direction in which the both of the flange portions face each other, a step in which the both of the flange portions of a three-dimensionally bent portion that is bent in the first plane and in the second plane are bent and brought closer to each other as compared with both of the flange portions in a portion other than the three-dimensionally bent portion, and a step of bringing ends of the flange portions into contact with each other.

(2) The method for manufacturing the bent hollow pipe described in (1) explained above, wherein in the step of bringing the flange portions into contact with each other, the flange portions are slid along an inner wall of the forming die, whereby the flange portions are brought into contact with each other.

(3) The method for manufacturing the bent hollow pipe described in (1) explained above, wherein in the step of bringing the flange portions into contact with each other, the flange portions are slid along an inner wall of a forming die, whereby the flange portions are brought into contact with each other, and at the same time, the flange portions are brought into contact with each other by the forming die partially using a core.

(4) The method for manufacturing the bent hollow pipe described in (3) explained above, wherein the core is partially applied to a position corresponding a portion where a length of the bent hollow pipe in the first direction in a cross section is longer than a length thereof in the third direction.

Advantageous Effects

According to the invention described in (1) explained above, in a case where a three dimensionally bent pipe is formed by forming bending between an extension portion and a flange portion in advance and thereafter bending bent portions between a push out portion and extension portions in a direction opposite to each other while maintaining this bending, a gap, an uneven thickness, and the like would not occur at contact portions at the ends of both of the flange portions when press work is finished, and thus a pipe having the high quality contact portions can be formed. Further, the method has the step for bending the both of the flange portions of the three-dimensionally bent portion and bringing the both of the flange portions of the three-dimensionally bent portion closer to each other as compared with the both of the flange portions other than the three-dimensionally bent portion, and therefore, in the step for forming the bent hollow pipe, the ends of the both of the flange portions of the three-dimensionally bent portion are first brought into contact with each other, and thereafter the peripheral portions are brought into contact with each other. Therefore, a gap, an uneven thickness, and the like would not occur at contact portions at the ends of both of the flange portions when press work is finished, and thus the three dimensionally bent hollow pipe having the high quality contact portions can be formed.

According to the invention described in (2) explained above, the flange portions are slid along the inner wall of the forming die, whereby the flange portions are brought into contact with each other, and therefore the bent hollow pipe can be formed without using any core.

According to the invention described in (3) explained above, the flange portions are slid along the inner wall of the forming die, whereby the flange portions are brought into contact with each other, and further the core is partially used, and therefore, this method can form even a bent hollow pipe that could not be formed without any core.

According to the invention described in (4) explained above, a core is partially applied in order to form a bent hollow pipe of which length in the first direction in the cross section is longer than the length thereof in the third direction, and therefore, the shape explained above, which could not be formed according to the conventional method, can be formed.

DESCRIPTION OF EMBODIMENTS

An embodiment of the present invention will be explained with reference to drawings. In the present embodiment, a plane in which a flat plate is arranged is defined as an XY plane (first plane), a direction in which the flat plate extends which is perpendicular to the X direction (first direction) is defined as a Y direction (second direction), and a direction perpendicular to the XY plane is defined as a Z direction (third direction). The bent hollow pipe according to the present embodiment extends while bending in a three-dimensional manner in the XY plane and the YZ plane (second plane), and the cross section in the XZ plane (third plane) is in a circular shape and a rectangular shape.

FIGS. 1 (A) to 1 (E) are figures illustrating a bent hollow pipe, in which FIG. 1 (A) is a perspective view, FIG. 1 (B) is a front view, FIG. 1 (C) is a top view taken along line C-C of FIG. 1 (B), FIG. 1 (D) is a cross sectional view taken along line D-D of FIG. 1 (B), and FIG. 1 (E) is a cross sectional view taken along line E-E of FIG. 1 (B).

For example, the bent hollow pipe 1 is a suspension arm used as a vehicle member, and in the present embodiment, the bent hollow pipe 1 is manufactured by bringing two sides of a flat plate in the YZ plane into contact with each other by pressing the flat plate.

The bent hollow pipe 1 extends while bending in a three dimensional manner as shown in FIG. 1, and has a circular cross section at one of the end portions and has a rectangular cross section at other of the end portions. The bent hollow pipe 1 is made from the flat plate, and therefore, a welding line 2 is formed over the Y direction. A rectangular portion 3 formed by the rectangular cross section is a portion where a collar of a suspension arm is attached, and is formed with a notched portion 4 for attaching a circular collar by welding and the like.

The cross sectional shape of the rectangular portion 3 is such that a length L1 of two sides, which are a side where the welding line 2 is provided and a side opposite thereto, is configured to be longer than a length L2 of the other two sides.

Subsequently, the method for manufacturing the bent hollow pipe according to the present embodiment will be explained.

Figure 1A:
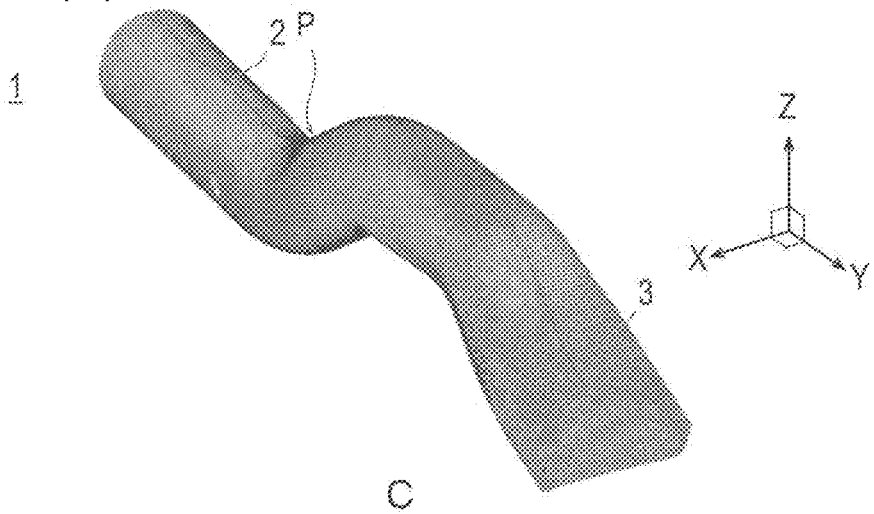
FIGS. 1 (A) to 1 (E) are figures illustrating a bent hollow pipe, in which FIG. 1 (A) is a perspective view, FIG. 1 B) is a front view, FIG. 1 (C) is a top view taken along line C-C of FIG. 1 (B), FIG. 1 (D) is a cross sectional view taken along line D-D of FIG. 1 (B), and FIG. 1 (E) is a cross sectional view taken along line E-E of FIG. 1 (B).
Figure 1B:
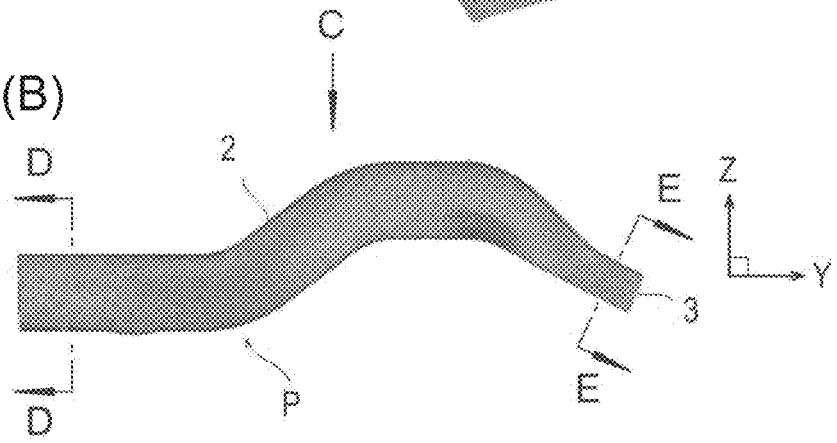
Figure 1C:
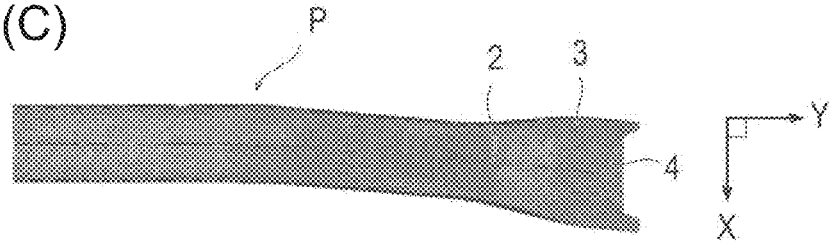
Figure 1D:
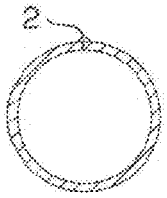
Figure 1E:
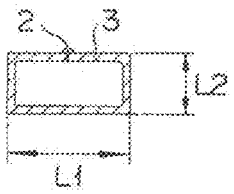
Figure 2:
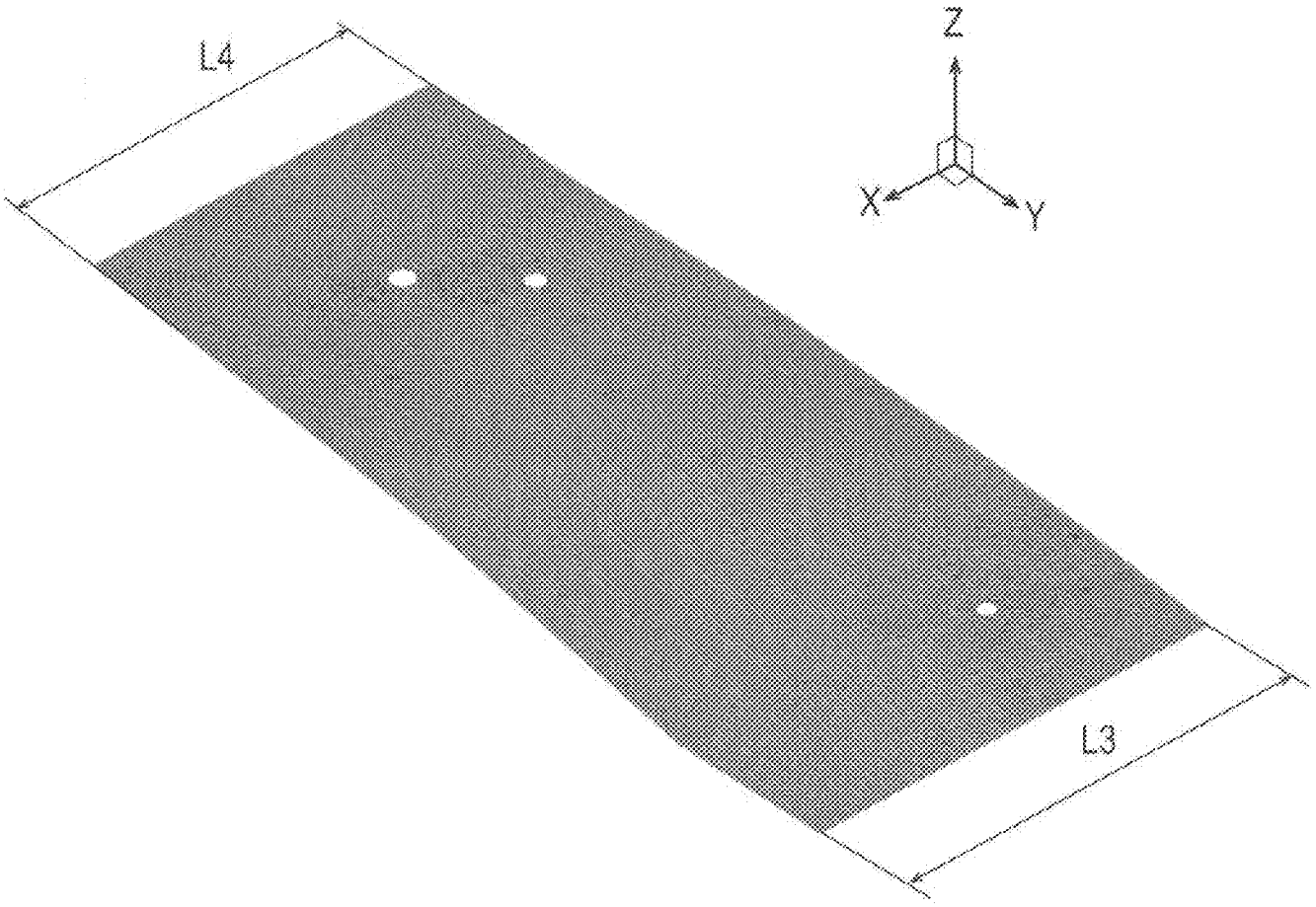
FIG. 2 is a perspective view illustrating a non-pressed flat plate of a bent hollow pipe according to the present embodiment.

FIG. 2 is a perspective view illustrating a non-pressed flat plate of a bent hollow pipe according to the present embodiment. In FIG. 2, after the forming, the lower right portion becomes the rectangular portion, and the upper left portion becomes the circular portion. Each of L3, L4 is set so as to be same as the lengths of the external peripheries of the rectangular portion and the circular portion after the pipe is formed.

Figure 3:
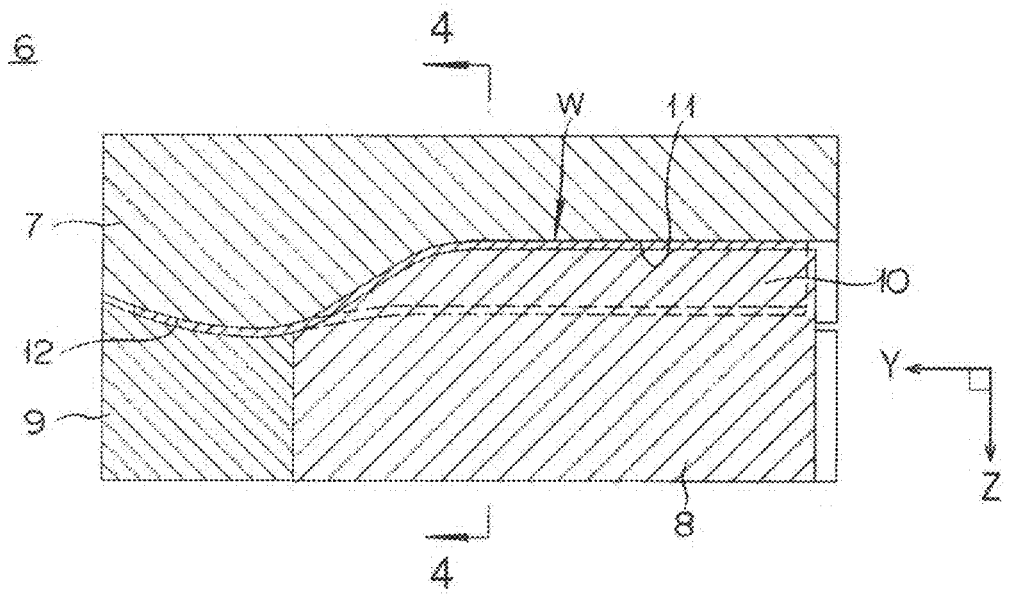
FIG. 3 is a cross sectional view illustrating a rough forming step of the method for manufacturing the bent hollow pipe according to the present embodiment.
Figure 4:
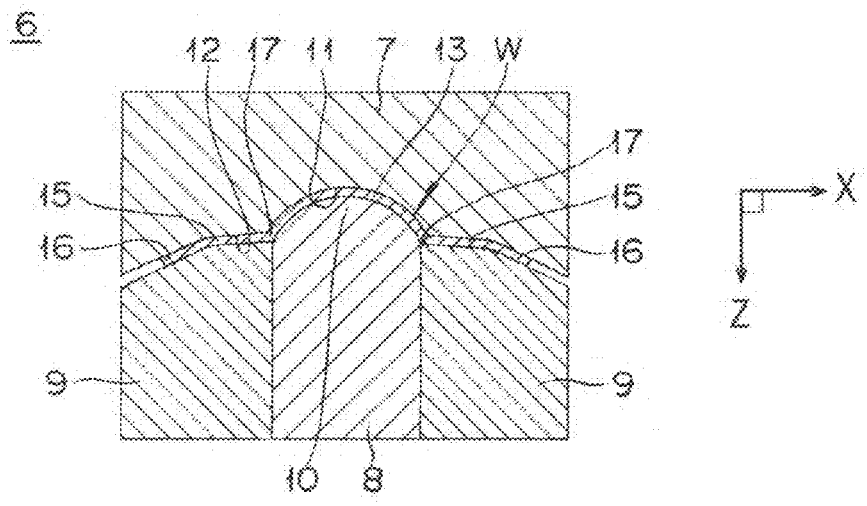
FIG. 4 is a cross sectional view taken along line 4-4 of FIG. 3.
Figure 5:
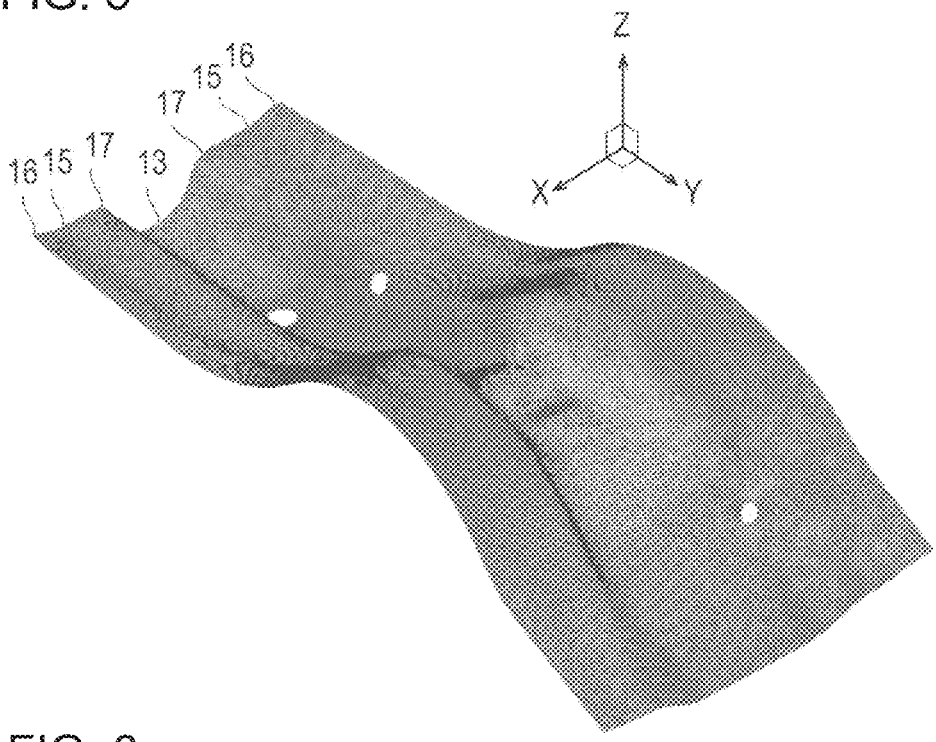
FIG. 5 is a perspective view illustrating a material, which is to be processed, when the rough forming step is finished.

FIG. 3 is a cross sectional view illustrating a rough forming step of a rough forming step of the method for manufacturing the bent hollow pipe according to the present embodiment. FIG. 4 is a cross sectional view taken along line 4-4 of FIG. 3. FIG. 5 is a perspective view illustrating a material, which is to be processed W, when the rough forming step is finished.

First, as shown in FIGS. 3, 4, the material W which is a metal flat plate is roughly formed by a first forming die 6 (rough forming step). The first forming die 6 includes a first upper die 7, a first lower die 8 provided to face the first upper die 7, and a blank holder 9. The first lower die 8 is formed with a protruding portion 10 that protrudes toward the first upper die 7 and extends on the surface facing the first upper die 7. The first upper die 7 is provided with a groove portion 11 that is depressed so as to correspond to the protruding portion 10 of the first lower die 8. Blank holders 9 are provided at the external peripheries of the first lower die 8, and the first upper die 7 is formed with holder surfaces 12 so as to face the blank holders 9. The holder surfaces 12 are formed at the external peripheries of the groove portion 11, and the holder surfaces 12 extend in the external peripheral direction. At the external peripheries thereof, the holder surface 12 is inclined in a direction toward the blank holder 9. The blank holder 9 is formed in a shape corresponding to the shape of the holder surface 12 of the first upper die 7.

In the rough forming step, first, the material W is placed in the first forming die 6, and while the first lower die 8 is kept away from the first upper die 7, the blank holder 9 and the first upper die 7 are brought close to each other, so that the material W is sandwiched by the first upper die 7 and the blank holder 9. At this occasion, a portion of the material W which is sandwiched between the first upper die 7 and the blank holder 9 is formed to extend in the external peripheral direction according to the shape of the holder surface 12, and incline so that the end thereof is in the direction toward the blank holder.

Thereafter, the first lower die 8 is brought close to the first upper die 7, and the material W is formed with a push out portion 13 that protrudes in a direction toward the first upper die 7 in association with the groove portion 11 of the first upper die 7. This push out portion 13 is pushed in the direction toward the first upper die 7, and is formed to be bent and extended thereto.

In the rough forming step, the material W is sandwiched by the blank holder 9, and therefore, this reduces unevenness of flow of the material W, so that generation of wrinkles and the like can be prevented.

As described above, in the rough forming step, extension portions 15 and flange portions 16 are formed. The extension portions 15 extend to be away from each other, and the extension portions 15 are formed at two sides at the outside of the push out portion 13 in the material W. The flange portions 16 are bent in the direction toward the blank holders 9 at the ends thereof. A bent portion 17 bent in the direction toward the first upper die 7 is formed between the push out portion 13 and the extension portion 15 (see FIG. 5).

Subsequently, an unnecessary portion of the external periphery portion of the material W that is roughly formed is trimmed (trimming step).

Figure 6:
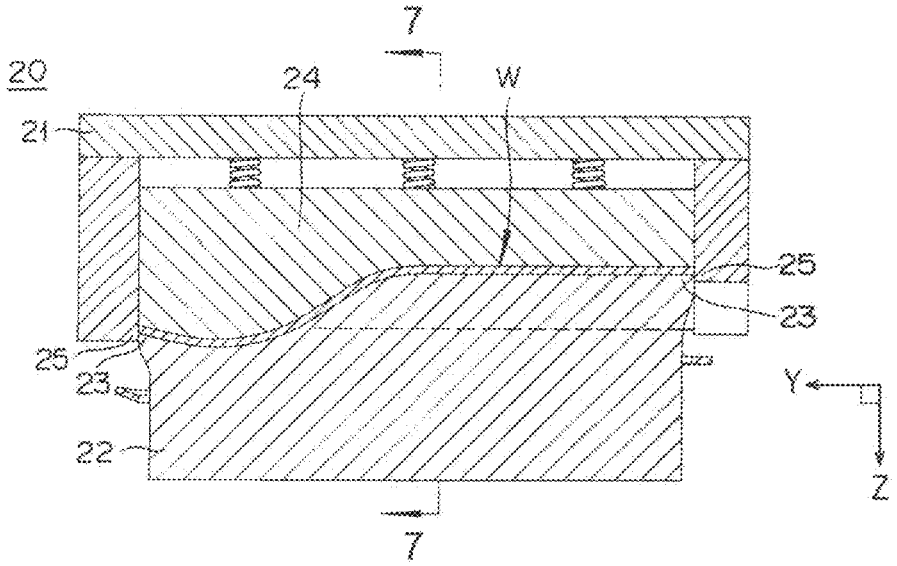
FIG. 6 is a cross sectional view illustrating a trimming step of the method for manufacturing the bent hollow pipe according to the present embodiment.
Figure 7:
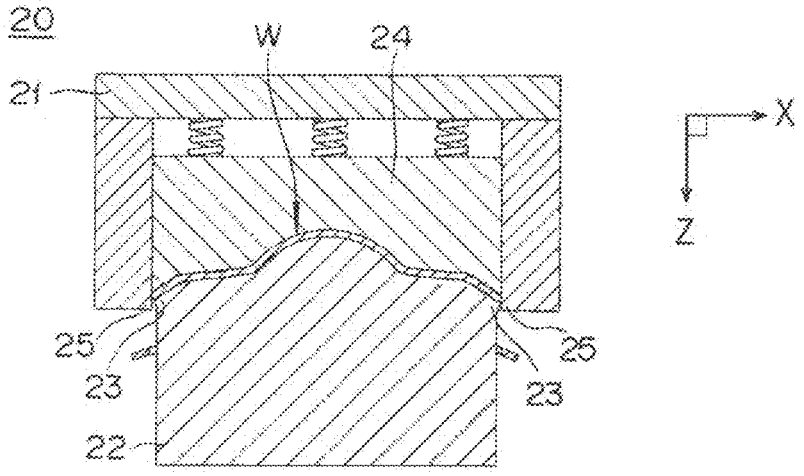
FIG. 7 is a cross sectional view taken along line 7-7 of FIG. 6.
Figure 8:
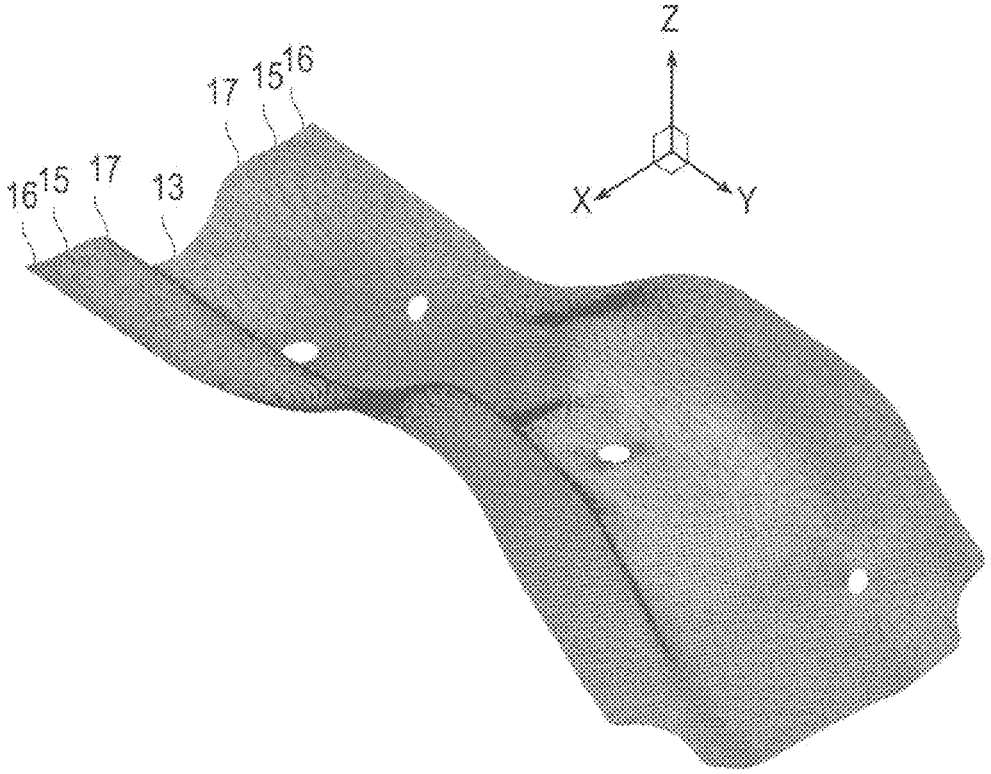
FIG. 8 is a perspective view illustrating a material, which is to be processed, when the trimming step is finished.

FIG. 6 is a cross sectional view illustrating the trimming step of the method for manufacturing the bent hollow pipe according to the present embodiment. FIG. 7 is a cross sectional view taken along line 7-7 of FIG. 6. FIG. 8 is a perspective view illustrating a material W when the trimming step is finished.

As shown in FIGS. 6, 7, the roughly-formed material W is trimmed by a second forming die 20. This second forming die 20 includes a second upper die 21 and a second lower die 22. The second lower die 22 is formed with a lower die cutting blade 23 on the external peripheral end of the surface facing the second upper die 21. The second upper die 21 includes a holder unit 24 and an upper die cutting blade 25. The holder unit 24 is arranged to face the second lower die 22 and arranged with springs on the back surface. The holder unit 24 is urged in the direction toward the second lower die 22. The upper die cutting blade 25 is arranged on the external periphery of the holder unit 24, and the upper die cutting blade 25 and the lower die cutting blade 23 make a pair. This holder unit 24 and the second lower die 22 have shapes corresponding to the shape of the material W.

In the trimming step, first, the roughly formed material W is placed in the second forming die 20, and the second upper die 21 and the second lower die 22 are brought close to each other. When the material W is sandwiched between the holder unit 24 of the second upper die 21 and the second lower die 22, the holder unit 24 is moved backward by the spring. When the holder unit 24 is moved backward, the material W is sandwiched between the upper die cutting blade 25 and the lower die cutting blade 23, and the external peripheral portion of the material W is cut off (see FIG. 8). Thereafter, when the second upper die 21 and the second lower die 22 are spaced apart from each other, the material W is pushed out from the second upper die 21 by the repulsive force of the springs.

Subsequently, the trimmed material W is bent (bending step).

Figure 9:
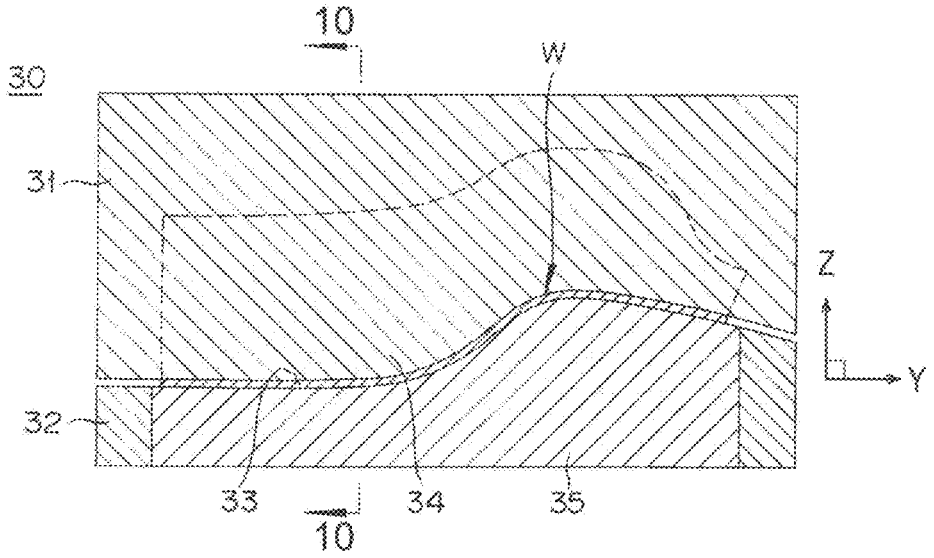
FIG. 9 is a cross sectional view illustrating a bending step of the method for manufacturing the bent hollow pipe according to the present embodiment.
Figure 10:
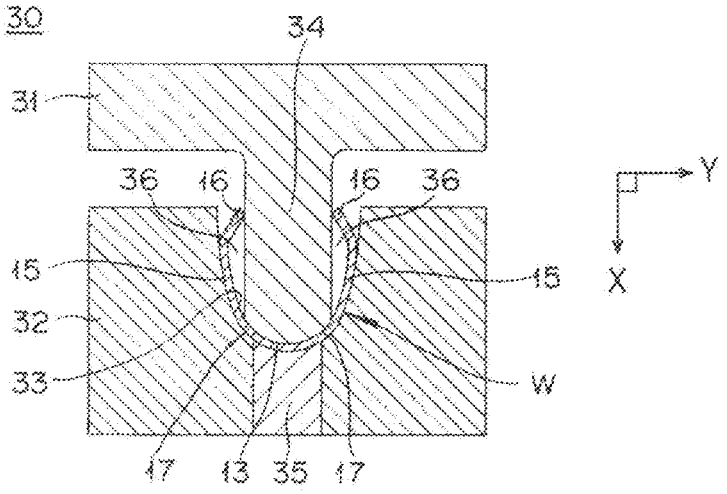
FIG. 10 is a cross sectional view taken along line 10-10 of FIG. 9.
Figure 11:
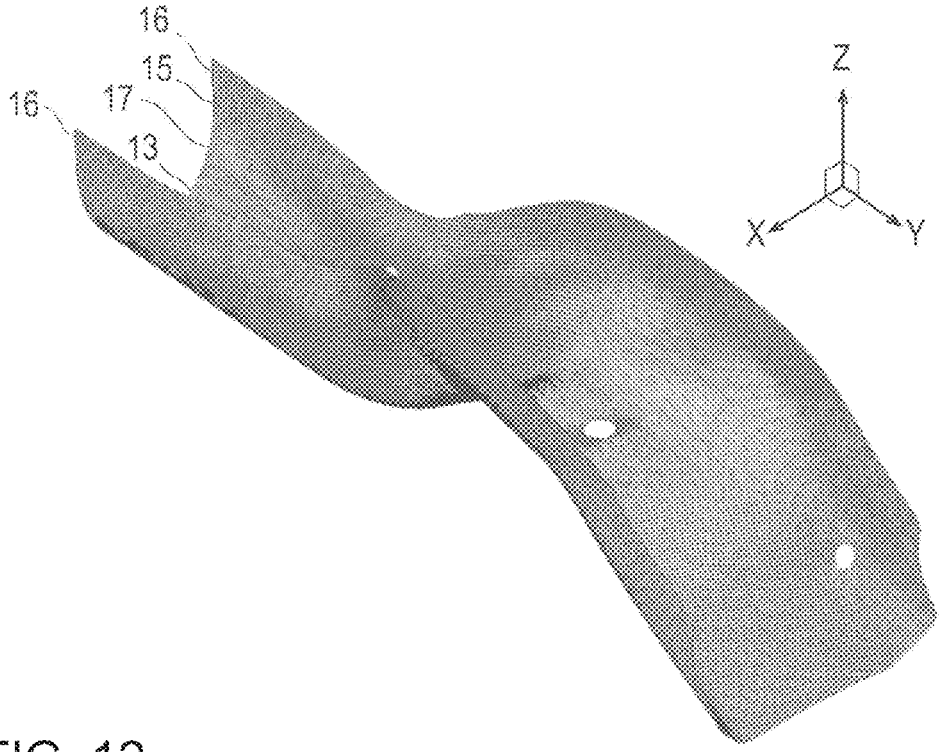
FIG. 11 is a perspective view illustrating a material, which is to be processed, when the bending step is finished.
Figure 12:
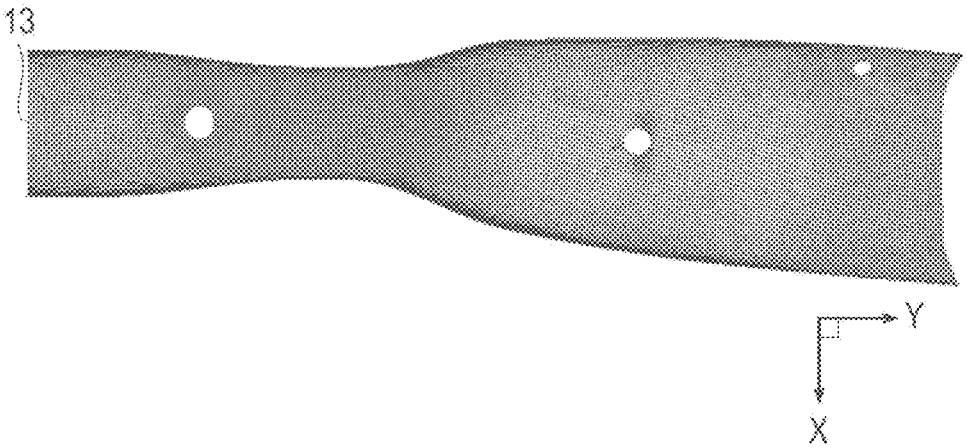
FIG. 12 is a top view illustrating the material, which is to be processed, when the bending step is finished.

FIG. 9 is a cross sectional view illustrating the bending step of the method for manufacturing the bent hollow pipe according to the present embodiment. FIG. 10 is a cross sectional view taken along line 10-10 of FIG. 9. FIG. 11 is a perspective view illustrating a material W when the bending step is finished. FIG. 12 is a top view illustrating the material W when the bending step is finished.

As shown in FIGS. 9, 10, the trimmed material W is placed in a third forming die 30 in such a manner that the trimmed material W is flipped upside down, and the trimmed material W is bent. The third forming die 30 includes a third lower die 32 having a groove portion 33 formed therein with which the material W is engaged, and a third upper die 31 having a protruding portion 34 engaging with the groove portion 33. In addition, the third lower die 32 is provided with a push out portion 35 configured to push out the formed material W from the groove portion 33.

In the bending step, first, the trimmed material W is placed in the third forming die 30 in such a manner that the trimmed material W is flipped upside down, and the third upper die 31 and the third lower die 32 are brought close to each other. When the material W is sandwiched between the protruding portion 34 of the third upper die 31 and the groove portion 33 of the third lower die 32, the bent portion 17 between the extension portion 15 and the push out portion 13 is bent in the opposite direction (direction toward the third upper die 31) along the groove portion 33, and the extension portions 15 at both sides of the push out portion 13 is formed in the direction toward the third upper die 31. It should be noted that a space larger than the thickness of the material W is provided between the side surfaces of the protruding portion 34 and the groove portion 33, and when the third forming die 30 reaches the bottom dead center (or top dead center), a gap 36 is formed between the side surface of the protruding portion 34 and the extension portion 15 of the material W. Therefore, bending is maintained between the extension portion 15 and the flange portion 16, and is formed in a direction in which both of the flange portions 16 face each other (see FIGS. 11, 12).

The material W, which has been formed by the third forming die 30, is pushed out from the groove portion 33 by the push out portion 35.

Subsequently, the material W, which has been bent in the bending step, is further bent, and both of the flange portions 16 of the three-dimensionally bent portion that is bent in the XY plane and the YZ plane are bent to be brought close to each other than both of the flange portions 16 other than the three-dimensionally bent portion (inner bending step).

Figure 13:
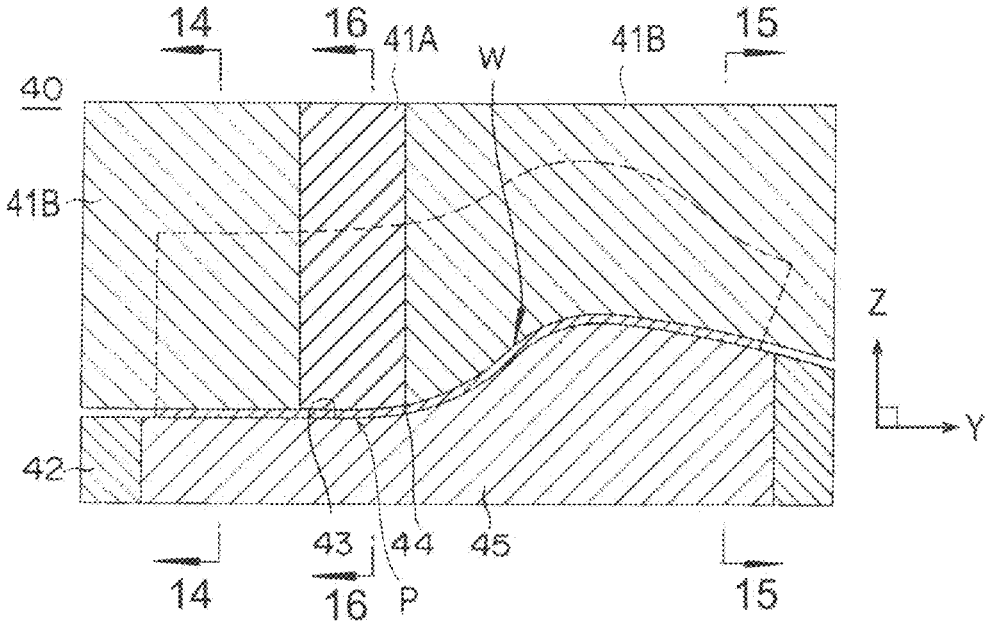
FIG. 13 is a cross sectional view illustrating an inner bending step of the method for manufacturing the bent hollow pipe according to the present embodiment.
Figure 14:
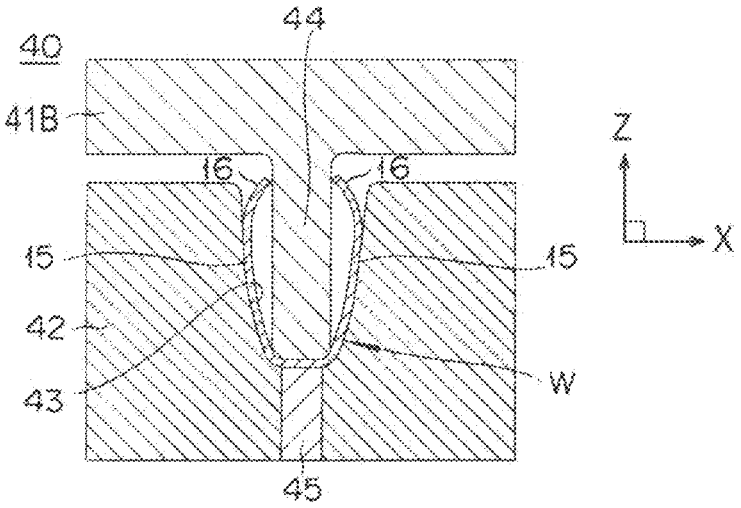
FIG. 14 is a cross sectional view taken along line 14-14 of FIG. 13.
Figure 15:
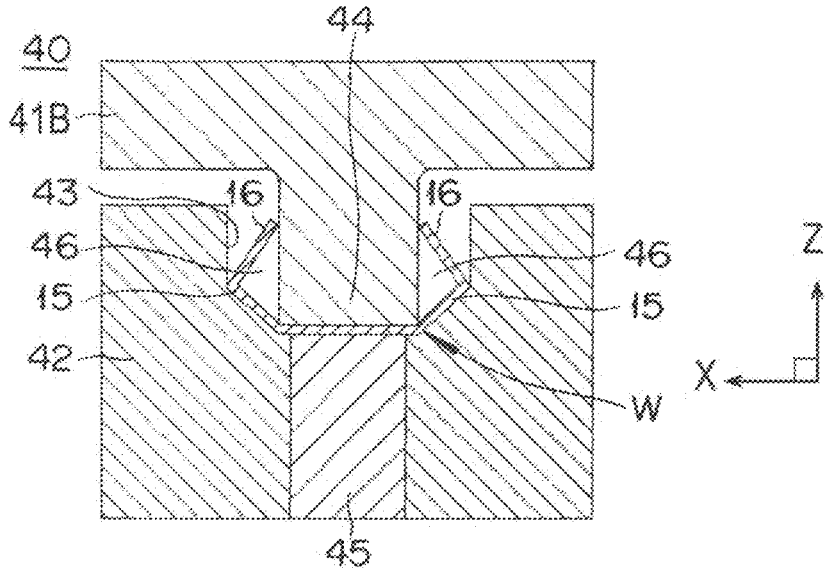
FIG. 15 is a cross sectional view taken along line 15-15 of FIG. 13.
Figure 16:
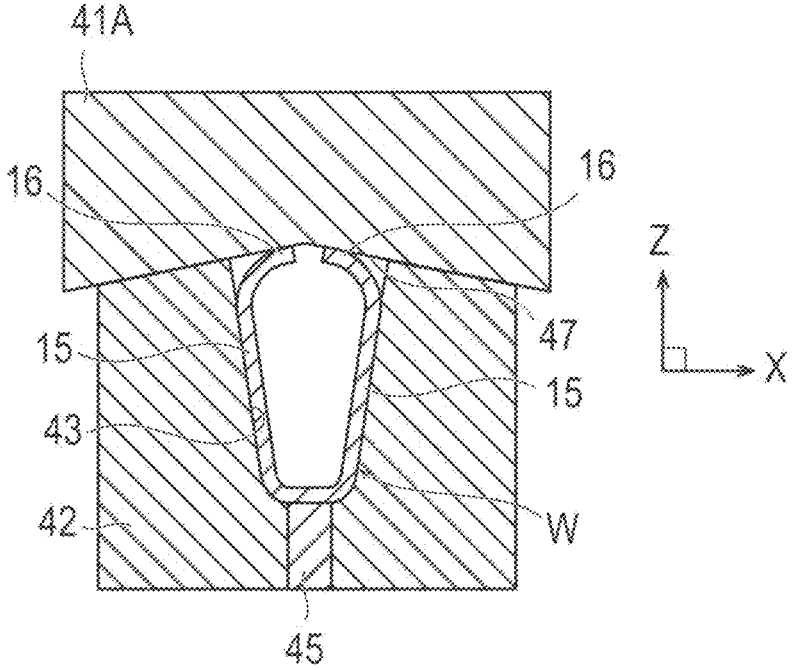
FIG. 16 is a cross sectional view taken along line 16-16 of FIG. 13.
Figure 17:
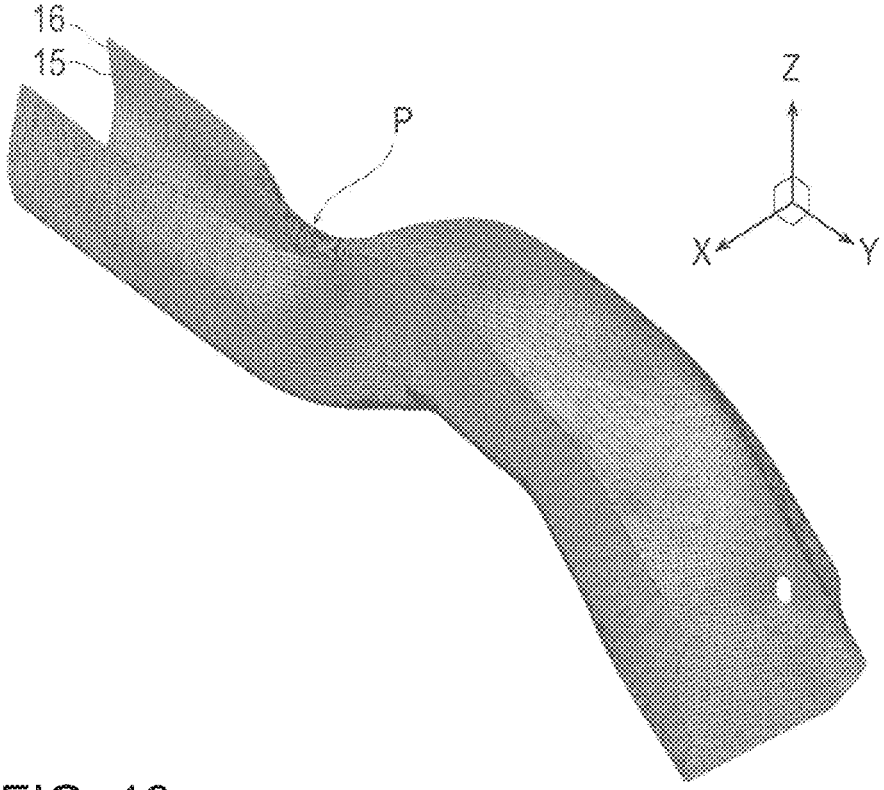
FIG. 17 is a perspective view illustrating the material, which is to be processed, when the inner bending step is finished.
Figure 18:
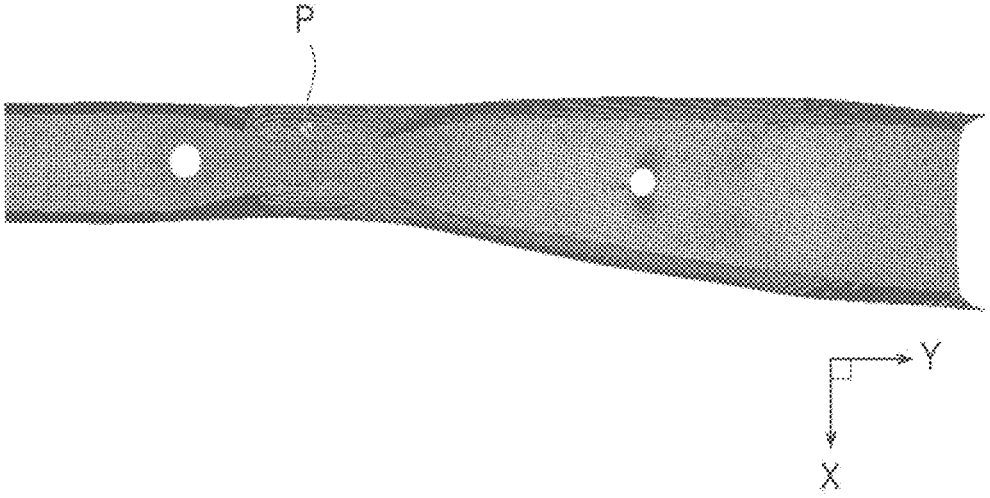
FIG. 18 is a top view illustrating the material, which is to be processed, when the inner bending step is finished.

FIG. 13 is a cross sectional view illustrating the inner bending step of the method for manufacturing the bent hollow pipe according to the present embodiment. FIG. 14 is a cross sectional view taken along line 14-14 of FIG. 13. FIG. 15 is a cross sectional view taken along line 15-15 of FIG. 13. FIG. 16 is a cross sectional view taken along line 16-16 of FIG. 13. FIG. 17 is a perspective view illustrating the material W when the inner bending step is finished. FIG. 18 is a top view illustrating the material W when the inner bending step is finished.

As shown in FIGS. 13 to 16, the material W, which has been bent in the bending step, is placed in a fourth forming die 40, and is further bent. The fourth forming die 40 includes a fourth upper die 41 and a fourth lower die 42 formed with a groove portion 43 with which the material W is engaged. The fourth upper die 41 is constituted by a fourth upper die 41A in proximity to the three-dimensionally bent portion P, and by a fourth upper die 41B in portions other than the portion in proximity to the three-dimensionally bent portion P. The fourth upper die 41A has a taper portion 47 with which both of the flange portions 16 of the three-dimensionally bent portion P are brought close to each other. The fourth upper die 41B has a protruding portion 44 that engages with the groove portion 43. The fourth lower die 42 has a push out portion 45 configured to push out the material W which is formed with the groove portion 43.

In the inner bending step, first, the material W is placed in the fourth forming die 40, and the fourth upper die 41 and the fourth lower die 42 are brought close to each other. Like the third forming die 30, a space larger than the thickness of the material W is provided, between the side surfaces of the protruding portion 44 and the groove portion 43, only in the portions other than the three-dimensionally bent portion P. When the fourth forming die 40 reaches the bottom dead center (or top dead center), a gap 46 is formed between the side surfaces of the protruding portion 44 and the material W. Therefore, over the longitudinal direction of the bent hollow pipe 1, bending is maintained between the extension portion 15 and the flange portion 16. It should be noted that the protruding portion 44 of the fourth forming die 40 is formed such that, at one side, the protruding portion 44 is formed to be longer in the pressing direction and formed to be narrower than the protruding portion 34 of the third forming die 30 (see FIG. 14), and at the other side, the protruding portion 44 is formed to be shorter in the pressing direction and formed to be wider than the protruding portion 34 of the third forming die 30 (see FIG. 15). In association with the protruding portion 44, the groove portion 43 of the fourth forming die 40 is formed such that, at one side, the groove portion 43 is formed to be longer in the pressing direction and formed to be narrower than the groove portion 33 of the third forming die 30 (see FIG. 14), and at the other side, the groove portion 43 is formed to be shorter in the pressing direction and formed to be wider than the groove portion 33 of the third forming die 30 (see FIG. 15). Therefore, the formed material W is formed to be longer in the pressing direction at one side and formed to be wider at the other side.

In proximity to the three-dimensionally bent portion P, the taper portion 47 is brought close to the fourth lower die 42, so that both of the flange portions 16 in proximity to the three-dimensionally bent portion P come closer to each other while being bent by the taper portion 47, and as a result, both of the flange portions 16 in proximity to the three-dimensionally bent portion P are more closer to each other than both of the flange portions 16 in the portions other than the three-dimensionally bent portion P (see FIGS. 16, 17, 18).

The material W, which is formed by the fourth forming die 40, is pushed out from the groove portion 43 by the push out portion 45.

Subsequently, the material W, which has been bent in the inner bending step, is further bent, and while the entire both of the flange portions 16 are brought close to each other, both of the flange portions 16 in proximity to the three-dimensionally bent portion P are brought into contact with each other (O press step).

Figure 19:
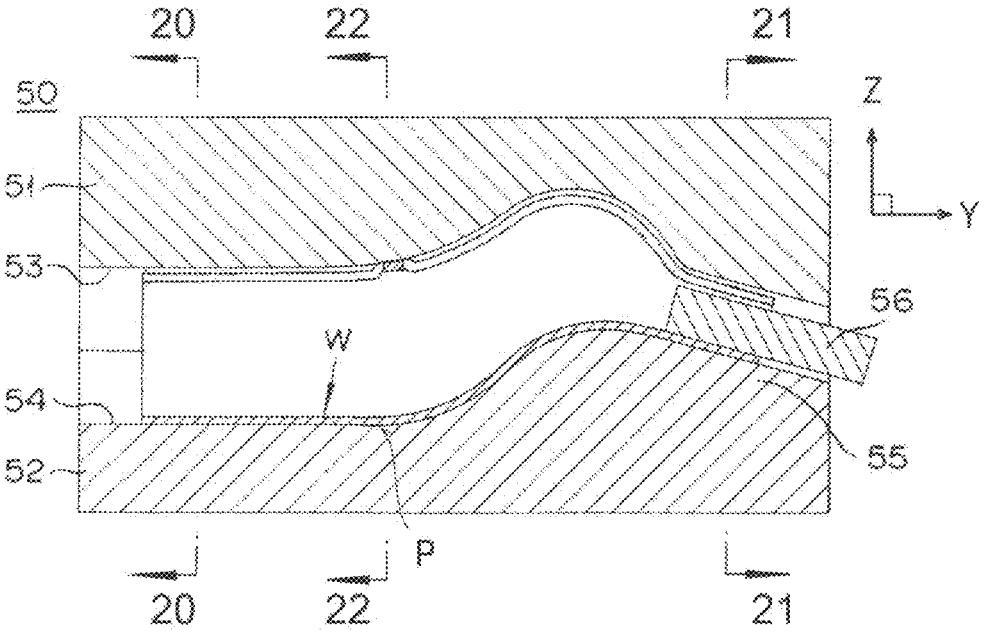
FIG. 19 is a cross sectional view illustrating an O press step of the method for manufacturing the bent hollow pipe according to the present embodiment.
Figure 20:
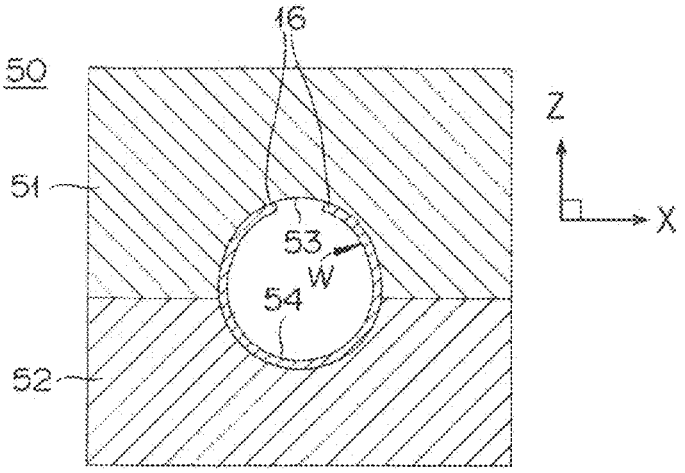
FIG. 20 is a cross sectional view taken along line 20-20 of FIG. 19.
Figure 21:
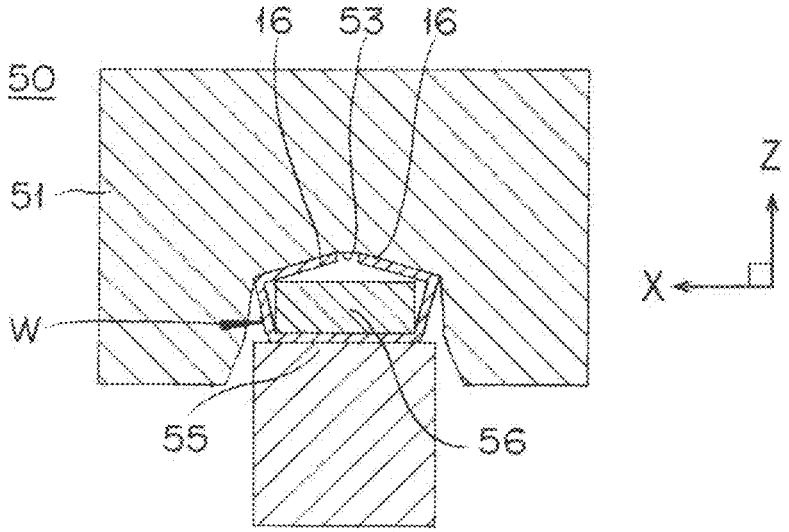
FIG. 21 is a cross sectional view taken along line 21-21 of FIG. 19.
Figure 22:
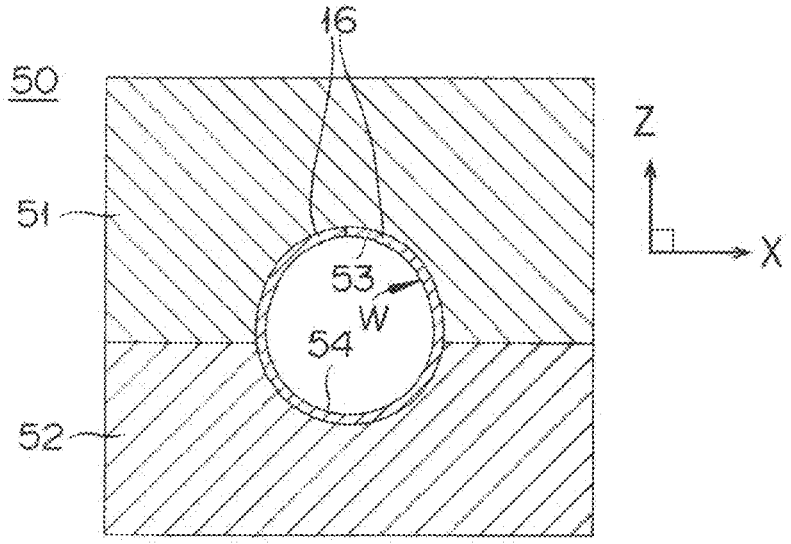
FIG. 22 is a cross sectional view taken along line 22-22 of FIG. 19.
Figure 23A:
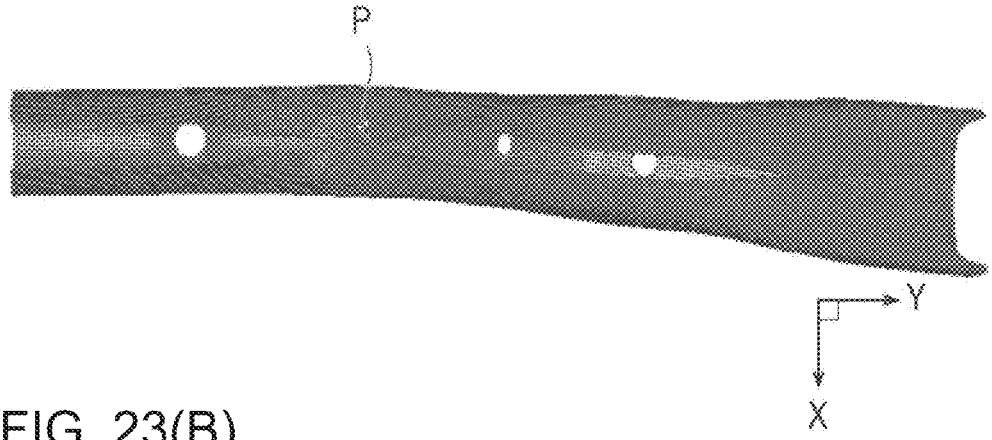
FIG. 23 (A) is a top view illustrating the material, which is to be processed, during the O press step, and FIG. 23 (B) is a top view illustrating the material, which is to be processed, when the O press step is finished.
Figure 23B:
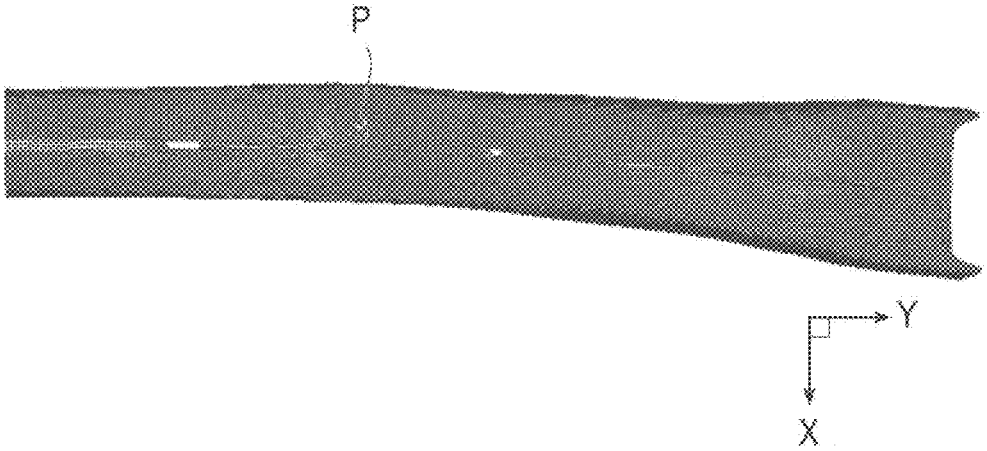
Figure 24:
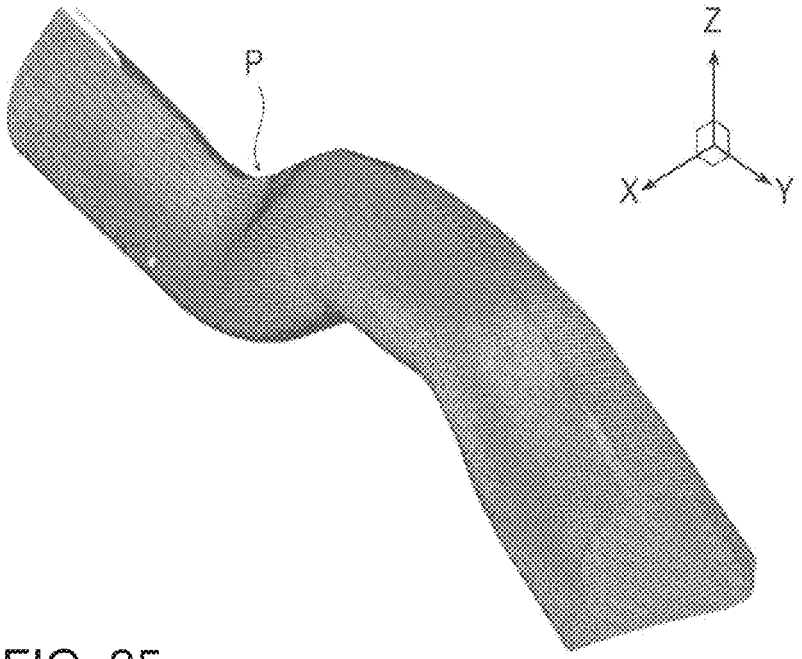
FIG. 24 is a perspective view illustrating the material, which is to be processed, when the O press step is finished.

FIG. 19 is a cross sectional view illustrating the O press step of the method for manufacturing the bent hollow pipe according to the present embodiment. FIG. 20 is a cross sectional view taken along line 20-20 of FIG. 19. FIG. 21 is a cross sectional view taken along line 21-21 of FIG. 19. FIG. 22 is a cross sectional view taken along line 22-22 of FIG. 19. FIG. 23 (A) is a top view illustrating the material, which is to be processed, during the O press step, and FIG. 23 (B) is a top view illustrating the material, which is to be processed, when the O press step is finished. FIG. 24 is a perspective view illustrating the material, which is to be processed, when the O press step is finished.

As shown in FIGS. 19 to 22, the material W, which has been bent in the inner bending step, is placed in a fifth forming die 50 and is further bent. The fifth forming die 50 includes a fifth upper die 51 having an upper die groove portion 53 formed therein with which the material W is engaged, and a fifth lower die 52 facing the fifth upper die 51.

The fifth lower die 52 includes a lower die groove portion 54 and a lower die projection portion 55. The lower die groove portion 54 is formed to be depressed in association with one end side of the upper die groove portion 53. The lower die projection portion 55 is formed to protrude in association with the other end side of the upper die groove portion 53. The lower die groove portion 54 is formed in the portion where the material W is formed to be longer in the push out direction in the inner bending step and in proximity to the three-dimensionally bent portion P, and the lower die projection portion 55 is formed in the portion where the material W is formed to be wider in the inner bending step.

In the O press step, first, the material W is placed in the fifth forming die 50 in such an orientation that the side at which the flange portion 16 is arranged is oriented toward the fifth upper die 51, and a core 56 of which cross section is in a rectangular shape is placed inside of the portion of the material W which corresponds to the lower die projection portion 55, and thereafter, the fifth upper die 51 and the fifth lower die 52 are brought close to each other. Between the upper die groove portion 53 and the lower die groove portion 54, the material W is formed to be longer in the push out direction, and therefore, by bringing the fifth upper die 51 and the fifth lower die 52 closer to each other, the ends of the both of the flange portions 16 come closer to each other while moving along the wall surface of the upper die groove portion 53 (see FIGS. 20, 23, 24).

Between the upper die groove portion 53 and the lower die projection portion 55, the material W is formed to be wider, and therefore, when the fifth upper die 51 and the fifth lower die 52 come closer to each other, the ends of the both of the flange portions 16 do not necessarily move along the wall surface of the upper die groove portion 53, but the core 56 prevents the flange portions 16 from entering into the inner side (see FIGS. 21, 23, 24).

In the inner bending step, both of the flange portions 16 in proximity to the three-dimensionally bent portion P are brought close to each other in advance, and therefore, when the fifth upper die 51 and the fifth lower die 52 come closer to each other, both of the flange portions 16 in proximity to the three-dimensionally bent portion P are brought into contact with each other (see FIGS. 22, 23, 24).

Subsequently, both of the flange portions 16 of the material W in the portions other than the portion in proximity to the three-dimensionally bent portion P are brought into contact with each other (contact step).

Figure 25:
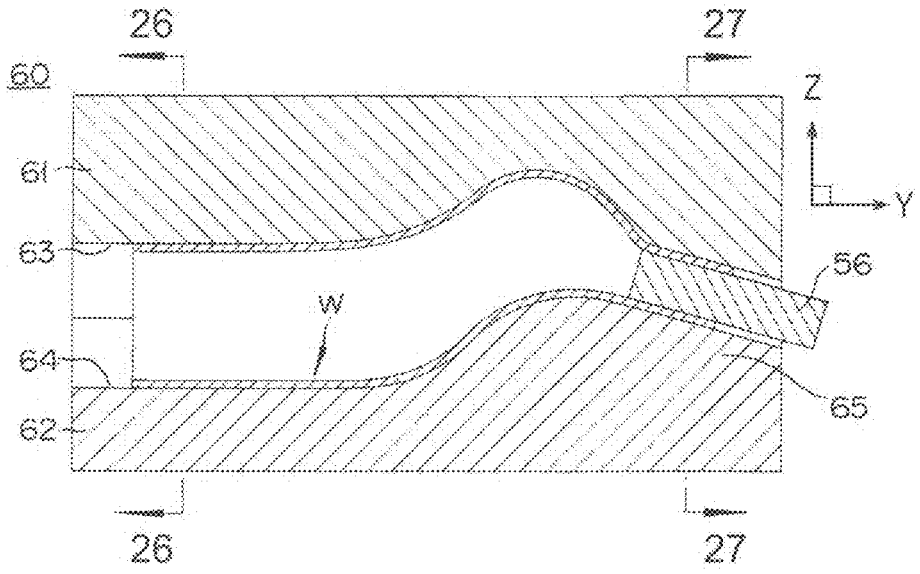
FIG. 25 is a cross sectional view illustrating a contact step of the method for manufacturing the bent hollow pipe according to the present embodiment.
Figure 26:
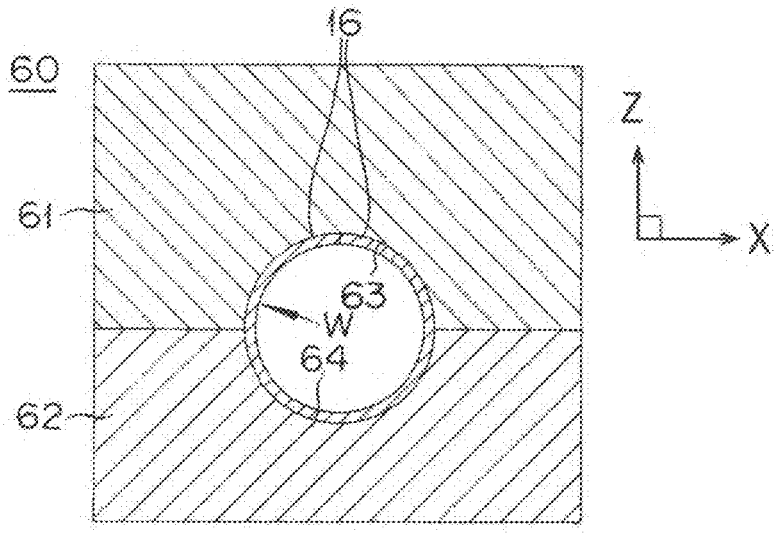
FIG. 26 is a cross sectional view taken along line 26-26 of FIG. 25.
Figure 27:
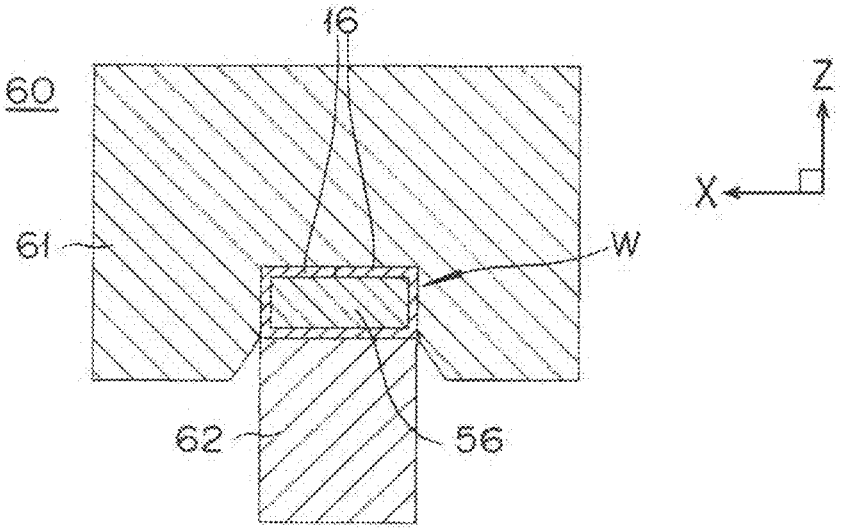
FIG. 27 is a cross sectional view taken along line 27-27 of FIG. 25.

FIG. 25 is a cross sectional view illustrating a contact step of the method for manufacturing the bent hollow pipe according to the present embodiment. FIG. 26 is a cross sectional view taken along line 26-26 of FIG. 25. FIG. 27 is a cross sectional view taken along line 27-27 of FIG. 25.

As shown in FIGS. 25 to 27, the material Win the portions other than the portion proximity to the three-dimensionally bent portion P where the both of the flange portions 16 are brought close to each other in the O press step is placed in a sixth forming die 60, and are bent until the ends of the material W are in contact with each other. The sixth forming die 60 includes a sixth upper die 61 having an upper die groove portion 63 formed therein with which the material W is engaged, and a sixth lower die 62 facing the sixth upper die 61.

The sixth lower die 62 includes a lower die groove portion 64 and a lower die projection portion 65. The lower die groove portion 64 is formed to be depressed in association with one end side of the upper die groove portion 63. The lower die projection portion 65 is formed to protrude in association with the other end side of the upper die groove portion 63. The lower die groove portion 64 is formed in the portion where the material W is formed to be longer in the push out direction in the inner bending step, and the lower die projection portion 65 is formed in the portion where the material W is formed to be wider in the inner bending step.

In the contact step, first, the material W is placed in the sixth forming die 60 in such an orientation that the side at which the flange portion 16 is arranged is oriented toward the sixth upper die 61, and while the core 56 placed in the O press step is still held in the inside of the portion of the material W which corresponds to the lower die projection portion 65, the sixth upper die 61 and the sixth lower die 62 are brought close to each other. Between the upper die groove portion 63 and the lower die groove portion 64, the material W is formed to be longer in the push out direction and the flange portions 16 are bent to the inside, and therefore, by bringing the sixth upper die 61 and the sixth lower die 62 closer to each other, the ends of the both of the flange portions 16 come closer to each other while moving along the wall surface of the upper die groove portion 63, and are ultimately brought into contact with each other. In this case, the diameters of the sixth upper die 61 and the sixth lower die 62 are smaller than the diameter of the bent hollow pipe 1. Therefore, after the ends of the both of the flange portions 16 are brought into contact with each other, compressive force is further exerted on the bent hollow pipe 1, and therefore, when the sixth upper die 61 is released from the sixth lower die, a phenomenon that the ends of the both of the flange portions 16 move away (spring back) is less likely to occur.

Between the upper die groove portion 63 and the lower die projection portion 65, the sixth upper die 61 and the sixth lower die 62 are brought close to each other, and accordingly, while the material W are sandwiched between the upper die groove portion 63, the lower die projection portion 65, and the core 56, the ends of the material W come closer to each other and are ultimately brought into contact with each other.

Subsequently, the notched portion 4 for attaching a circular collar is formed in the rectangular portion 3 of the material W (cutting step).

Figure 28:
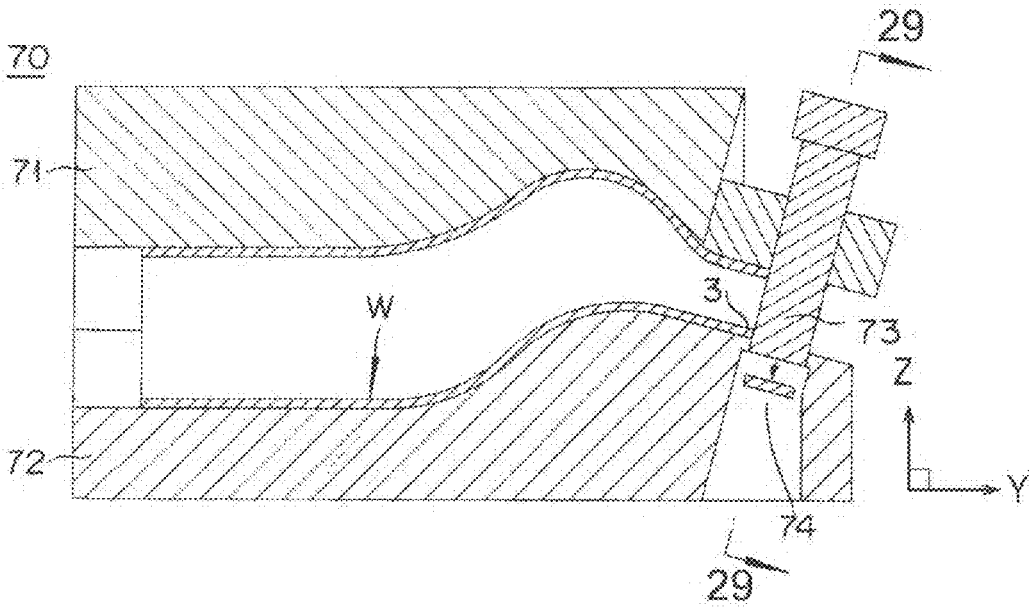
FIG. 28 is a cross sectional view illustrating a cutting step of the method for manufacturing the bent hollow pipe according to the present embodiment.
Figure 29:
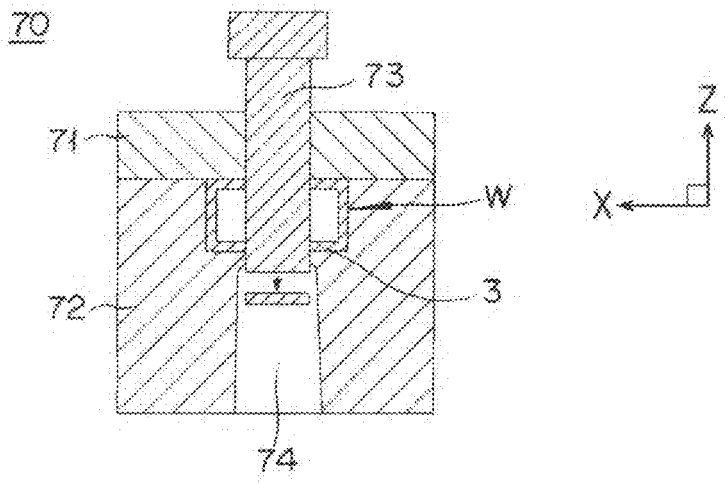
FIG. 29 is a cross sectional view taken along line 29-29 of FIG. 28.

FIG. 28 is a cross sectional view illustrating a cutting step of the method for manufacturing the bent hollow pipe according to the present embodiment. FIG. 29 is a cross sectional view taken along line 29-29 of FIG. 28.

As shown in FIGS. 28, 29, the core 56 is withdrawn from the material W, of which ends of the flange portions 16 are brought into contact with each other in the contact step, and the material W is placed in a seventh forming die 70. The seventh forming die 70 is formed in association with the shape of the material W, and includes a seventh upper die 71 and a seventh lower die 72 with which the material W can be sandwiched.

The seventh upper die 71 is provided with a cutting unit 73 that can move back and forth with respect to the rectangular portion 3 of the material W using a cam mechanism, and the seventh lower die 72 is provided with a cutting hole 74 through which the cutting unit 73 can penetrate. It should be noted that the direction in which the cutting unit 73 moves back and forth is different from the pressing direction of the seventh forming die 70.

In the cutting step, first, the material W is placed in the seventh forming die 70, and the cutting unit 73 is moved forward with respect to the rectangular portion 3 of the material W, and the surface adjacent to the cutting hole 74 of the rectangular portion 3 is cut by the cutting unit 73 and the cutting hole 74, and the notched portion 4 for attaching the circular collar is formed in the rectangular portion 3 of the material W. Thereafter, the material W is retrieved from the seventh forming die 70, and unnecessary portions of the both end portions 16 are cut off (not shown), and the ends of the both of the flange portions 16 which are brought into contact with each other are welded, and thus the formation is completed.

Figure 30:
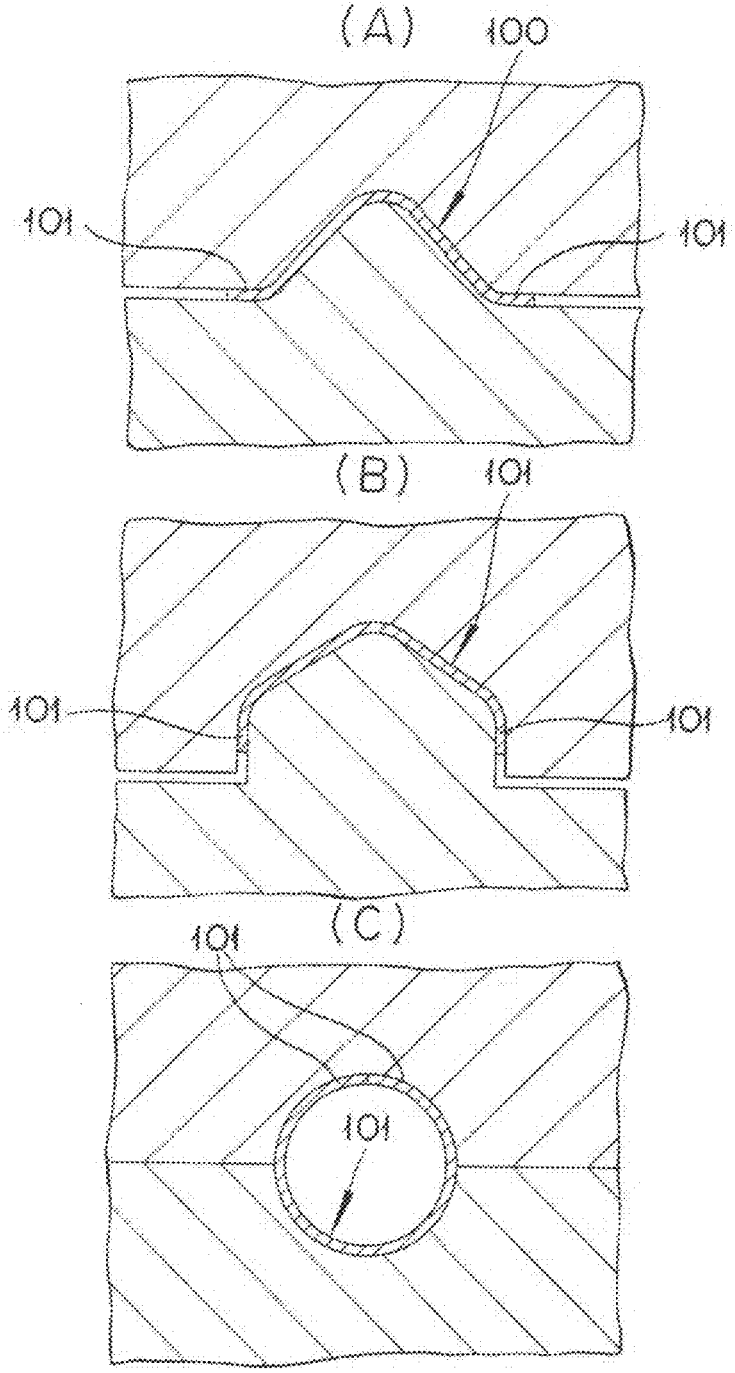
FIG. 30 is a cross sectional view for explaining a conventional method for manufacturing a bent hollow pipe.

As described above, according to the method for manufacturing the bent hollow pipe according to the present embodiment, the bent flange portions 16 are formed at the ends of the extension portions 15 in the rough forming step, and therefore, the three-dimensionally bent hollow pipe 1 can be formed. More specifically, FIG. 30 shows a conventional method for manufacturing a bent hollow pipe, and in the conventional method, first, flange portions 101 extended in directions away from each other are formed in a flat plate 100 (FIG. 30 (A)), and subsequently, the flange portions 101 are bent in a press direction so that both of the flange portions 101 are in substantially parallel with each other (FIG. 30 (B)), and thereafter, the both of the flange portions 101 are brought into contact with each other along the inner wall of the forming die, and thus a pipe is formed (FIG. 30 (C)). In this method, a two dimensionally bent hollow pipe can be formed, but when a three dimensionally bent hollow pipe is tried to be formed, and when the both of the flange portions 101 are bent in a press direction so that the both of the flange portions 101 are in substantially parallel with each other (see FIG. 30 (B)), one of the flange portions 101 may be drawn in to be short or become too long, and therefore, this makes it difficult to do forming. In contrast, in the present embodiment, in the rough forming step, the bent flange portions 16 are formed in advance at the ends of the extension portions 15, and the bent portions 17 between the extension portions 15 and the push out portion 13 are bent in the opposite directions in the bending step, so that the both of the flange portions 16 can be bent in the opposite directions, and therefore, a gap, an uneven thickness, and the like would not occur at contact portions at the ends of both of the flange portions 16 when press work is finished, and thus the three dimensionally bent hollow pipe 1 having the high quality contact portions can be formed. Further, the method has the step for bending the both of the flange portions 16 of the three-dimensionally bent portion P and bringing the both of the flange portions 16 of the three-dimensionally bent portion P closer to each other as compared with the both of the flange portions 16 other than the three-dimensionally bent portion P, and therefore, in the step for forming the bent hollow pipe 1, the both of the flange portions 16 of the three-dimensionally bent portion P are first brought into contact with each other, and thereafter the peripheral portions are brought into contact with each other. Therefore, a gap, an uneven thickness, and the like would not occur at contact portions at the ends of both of the flange portions 16 when press work is finished, and thus the three dimensionally bent hollow pipe 1 having the high quality contact portions can be formed.

In the conventional method, no core is used, and therefore, a wide hollow member of which length in the pressing direction is short (see FIG. 1 (D)) cannot be formed, but in the present embodiment, the core 56 is partially used, and therefore, a wide hollow member of which length in the pressing direction is short partially can be formed.

It should be noted that the present invention is not limited to the embodiment describe above, and can be modified in various manners within the scope of the claims. For example, the trimming step and the cutting step may be omitted. Depending on the shape of the bent hollow pipe, the embodiment can be carried out without using any core. For example, the embodiment can also be applied to a bent hollow pipe other than a suspension arm.

DESCRIPTION OF SYMBOLS

1: Bent hollow pipe,
2: Welding line,
3: Rectangular portion,
6, 20, 30, 40, 50, 60, 70: Forming die,
13: Push out portion,
15: Extension portion,
16: Flange portion,
17: Bent portion,
56: Core,
L1, L2: Length of rectangular portion in cross section,
P: Three-dimensionally bent portion,
W: Material which is to be processed.

The invention claimed is:

1. A method for manufacturing a bent hollow pipe, in which a material, which is to be processed and which is a flat plate extending in a first plane formed by a first direction and a second direction perpendicular to the first direction, is pressed in a stepwise manner using a plurality of forming dies from a third direction perpendicular to the first plane, so that two sides of a second plane formed by the second direction and the third direction of the material are brought into contact with each other, and the bent hollow pipe is made to be bent and extend in a three dimensional manner that is bent in the first plane and in the second plane, the method comprising:

providing a material which is a flat plate extending in a first plane formed by a first direction and a second direction perpendicular to the first direction;

forming a push out portion that is pushed out onto the material in the third direction and that is bent and extends within a third plane formed by the first direction and the third direction in a presswork, wherein extension portions are formed to extend away from each other at both sides which sandwich the push out portion of the material, and flange portions are formed that are bent, in a direction opposite to a push out direction of the push out portion, at ends of the extension portions;

bending bent portions between the push out portion and the extension portions in the opposite directions while bending is maintained between the extension portions and the flange portions, so that the both of the flange portions are formed in a direction in which the both of the flange portions face each other;

bending both of the flange portions of a three-dimensionally bent portion in the first plane and in the second plane, wherein the flange portions are bent and brought closer to each other as compared with both of the flange portions in a portion other than the three-dimensionally bent portion; and bringing ends of the flange portions into contact with each other.

2. The method for manufacturing the bent hollow pipe according to claim 1, wherein bringing the flange portions into contact with each other comprises sliding the flange portions along an inner wall of the forming die, whereby the flange portions are brought into contact with each other.

3. The method for manufacturing the bent hollow pipe according to claim 1, wherein bringing the flange portions into contact with each other comprises sliding the flange portions along an inner wall of a forming die, whereby the flange portions are brought into contact with each other, and wherein the flange portions are brought into contact with each other by the forming die partially using a core.

4. The method for manufacturing the bent hollow pipe according to claim 3, wherein the core is partially applied to a position corresponding to a portion where a length of the bent hollow pipe in the first direction in a cross section is longer than a length thereof in the third direction.

5. The method of claim 1, wherein the material is pressed in a stepwise manner using a plurality of forming dies from a third direction perpendicular to the first plane, so that two sides of a second plane formed by the second direction and the third direction of the material are brought into contact with each other.

6. The method of claim 1, wherein the ends of the flange portions are brought into contact with each other along the inner wall of a forming die to form the bent hollow pipe.

7. The method of claim 6, wherein the bent hollow pipe is configured to be bent and extend in a three dimensional manner that is bent in the first plane and in the second plane.

* * * * *